US006755704B1

(12) United States Patent
Leinonen

(10) Patent No.: US 6,755,704 B1
(45) Date of Patent: Jun. 29, 2004

(54) OIL TANK DRAIN SYSTEM FOR WATERCRAFT

(75) Inventor: Brian Leinonen, Spencer, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/346,852

(22) Filed: Jan. 13, 2003

(51) Int. Cl.[7] ..... B63H 21/38
(52) U.S. Cl. ..... 440/88 L; 184/1.5
(58) Field of Search ..... 440/88 R; 184/1.5

(56) References Cited

U.S. PATENT DOCUMENTS 3,103,947 A 9/1963 Mueller ..... 137/351
3,908,797 A 9/1975 Schnepp ..... 184/1.5
4,875,884 A 10/1989 Meisenburg ..... 440/88
4,986,777 A 1/1991 Preston ..... 440/88
5,899,779 A 5/1999 Hattori ..... 440/88
6,050,867 A 4/2000 Shields et al. ..... 440/88

*Primary Examiner*—Jesus D. Sotelo
(74) *Attorney, Agent, or Firm*—Natalie D. Kadievitch; Fredrickson & Byron, P.A.

(57) ABSTRACT

An oil drain system and method for draining oil for a personal watercraft that includes an oil reservoir coupled to a flow regulator, located in the interior of the personal watercraft. The flow regulator is additionally coupled to a cover that seals an access opening formed on the exterior of the personal watercraft by means of a tether such that when the cover is removed for an oil change the tether pulls the flow regulator to the exterior of the watercraft so that oil in the reservoir can be drained to the exterior of the watercraft.

27 Claims, 6 Drawing Sheets

OIL TANK DRAIN SYSTEM FOR WATERCRAFT

FIELD OF THE INVENTION

This invention relates to a watercraft such as a personal watercraft and more particularly to an improved oil drain system therefore.

BACKGROUND

Personal watercrafts are a popular type of watercraft in which one or more passengers ride on rather than in the watercraft. Personal watercrafts are powered by jet propulsion devices coupled to engines. The engines are typically of the 2-stroke or 4-stroke variety. The 2-stroke variety is fueled by an oil/gasoline mix and the four-stroke by gasoline.

Watercrafts powered by 4-stroke engines provide many advantages. As compared to 2-stroke engine powered watercrafts, 4-stroke watercrafts consume less fuel, emit less noise and pollution, and are more powerful. However, a disadvantage is the inconvenient process by which oil is removed for routine oil changes.

Four-stroke engines are typically provided with oil reservoirs positioned under the cylinder block. Because the engine is positioned so that the drive shaft extends horizontally, the oil reservoir is positioned under the engine. In a typical 4-stroke watercraft the oil drain access is provided on the top of the oil reservoir. Generally, an access panel is provided at the top of the hull for maintenance. Such a configuration requires the use of a siphon or powered pump to remove the oil from the reservoir and makes routine oil changes cumbersome and inconvenient.

Several attempts to facilitate oil draining from watercrafts have been made. These attempts, however, generally require the use of inconvenient specialized tools, rearrangement of the engine within the hull, or require the service person to manipulate valves located in the interior of the watercraft. For example, U.S. Pat. No. 6,050,867 discloses a drain system for a marine vessel wherein a multiple conduit structure connecting the oil reservoir to ah access in the transom provides for oil draining. A valve, positioned in the interior of the vessel, provides for controlling the flow of oil through the conduit.

U.S. Pat. No. 4,986,777 discloses a marine engine oil drainage device wherein a conduit connects the oil pan of the marine engine to a drainage port in the stem of a marine vessel. A valve is attached to the conduit in the interior of the vessel. The valve is actuated by either the use of a specialized tool or other means requiring the service person to place his or her hands into the interior of the hull of the marine vessel.

U.S. Pat. No. 5,899,779 discloses an oil system drain for personal watercraft wherein the oil reservoir is positioned within the interior of the watercraft such that an oil plug can be accessed from an opening in the bottom of the hull of the watercraft.

It is desirable therefore, to provide an oil drain system for a typical watercraft that allows for convenient routine maintenance.

SUMMARY OF THE INVENTION

The present invention provides an improved oil drain system for vehicles with an oil reservoir located within the interior of a vehicle compartment. According to one aspect of the invention there is provided an oil drain system comprising an oil reservoir coupled to a flow regulator, located within the interior of a vehicle. The exterior of the vehicle includes an access opening with a cover removably located over the access opening on the exterior of the vehicle. A tether couples the flow regulator of the oil reservoir to the interior of the cover, wherein when the cover is removed from the access opening, the flow regulator can be pulled through the access opening by the tether so that oil can be drained to the exterior of the vehicle.

According to another aspect of the invention, there is provided a jet-propelled personal watercraft comprising; a hull including a bottom hull and a top deck secured over the bottom hull, the hull defining an engine compartment sized to contain an internal combustion engine for powering a jet propulsion unit, the jet propulsion unit including a steerable water discharge nozzle, the top having a raised, longitudinally extending seat adapted to accommodate an operator in straddle fashion. Jet-propelled personal watercraft includes a lubricating system to lubricate the engine. The lubricating system includes an oil reservoir with a drain formed therein. The oil reservoir is coupled to a flow regulator. Jet-propelled personal watercraft further includes an access opening and a cover having an interior and exterior removably located over the access opening. The flow regulator of the oil reservoir is coupled to the interior of the access opening cover by means of a tether.

The aforedescribed configuration allows for convenient routine oil changes. According to another aspect of the present invention there is provided a method of draining oil from a vehicle containing the oil drain system described above. To drain the oil, the service person removes a cover from an access opening located on an exterior of the vehicle and pulls the cover away from the access opening. Because the cover has a tether coupling the it to a flow regulator that has an open and closed position and the flow regulator is coupled to an oil reservoir located in an interior of the vehicle, as the cover is removed the tether pulls the flow regulator through the access opening making it accessible from the exterior of the vehicle. With the flow regulator at the exterior of the vehicle, the service person can open the flow regulator and drain the oil. When the draining is complete, the service person closes the flow regulator and returns it to the interior of the vehicle and finally, replaces the cover over the access opening.

In accordance with another aspect the present invention provides an oil drain system comprising an oil reservoir with an oil drain formed therein with draining means attached at its proximal end to the oil drain. Connecting means is attached at its proximal end to the distal end of the draining means and at its distal end to an access opening cover means.

DETAILED DESCRIPTION OF THE PRESENTLY PREFERRED EMBODIMENTS OF THE PRESENT INVENTION

The following detailed description should be read with reference to the drawings, in which like elements in different drawings are numbered identically. The drawings depict selected embodiments and are not intended to limit the scope of the invention. It will be understood that embodiments shown in drawings and described above are merely for illustrative purposes, and are not intended to limit scope of the invention as defined in the claims that follow.

Figure 1:
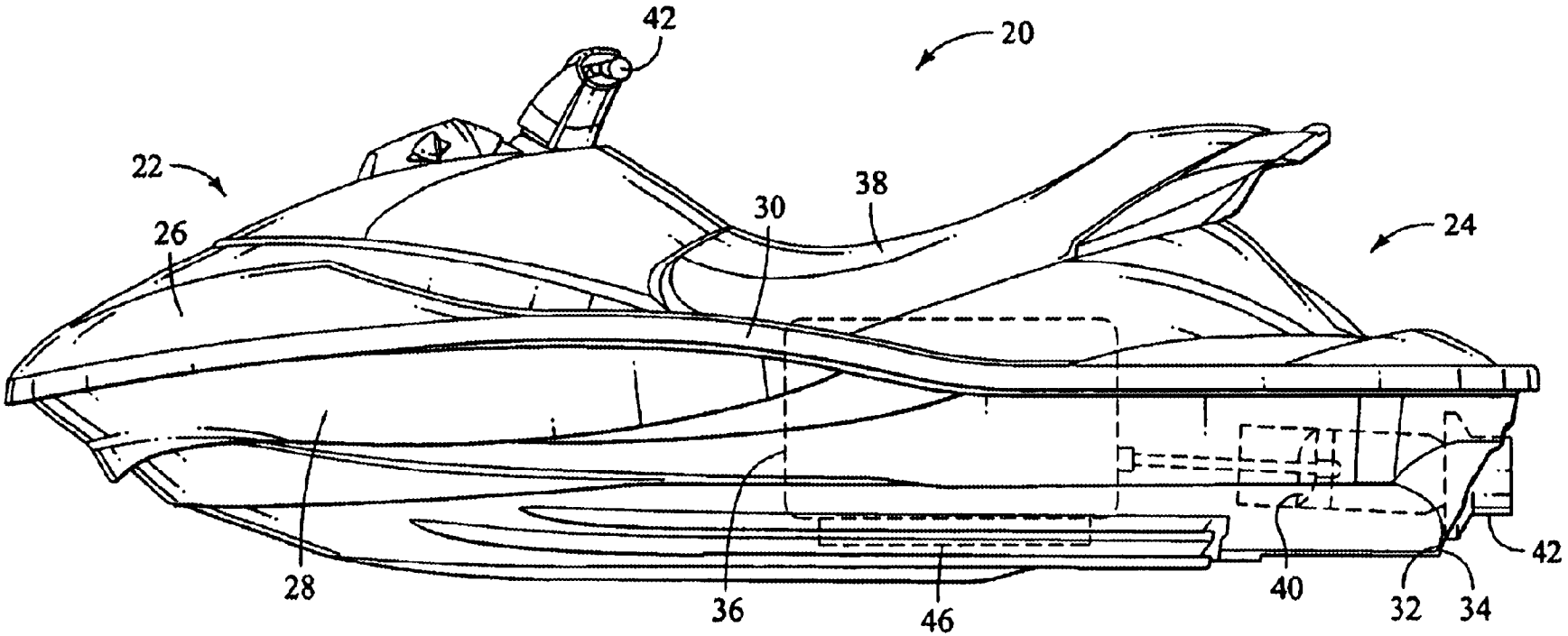
FIG. 1 is a schematic of a typical personal watercraft.

FIG. 1 illustrates a personal watercraft 20 having generally a front or bow 22 and a rear or stern 24. Personal watercraft 20 includes a top deck 26 secured to a bottom hull 28 along an overlapping portion covered with a rub rail 30 in the embodiment illustrated, forming a hull. The hull includes a water drain opening 32 that is sealed by a cover 34. The hull formed by the bottom hull 28 and top deck 26 define a compartment sized to contain an internal combustion engine 36 for powering the watercraft, and may also include one or more storage compartments, depending upon the size and configuration of the watercraft. The deck portion 26 also has a raised, longitudinally extending seat 38 adapted to accommodate one or more riders seated in straddle fashion on the scat 38. Engine 36 powers a jet propulsion unit 40, typically mounted in a tunnel at the bottom rear portion of the watercraft. Jet propulsion unit 40 includes a steerable water discharge nozzle 42 that is operatively connected to a set of handlebars 44 to facilitate steering of the watercraft by the operator. The engine 36 may be of the two or four cycle variety. Of course, the engine 36 may have as few as one, or more than two cylinders, as appreciated by those skilled in the art. In engines of the four-stroke variety, the engine 36 includes a lubricating system (not shown). The lubricating system includes an oil reservoir 46 that must be drained and refilled routinely.

Figure 2:
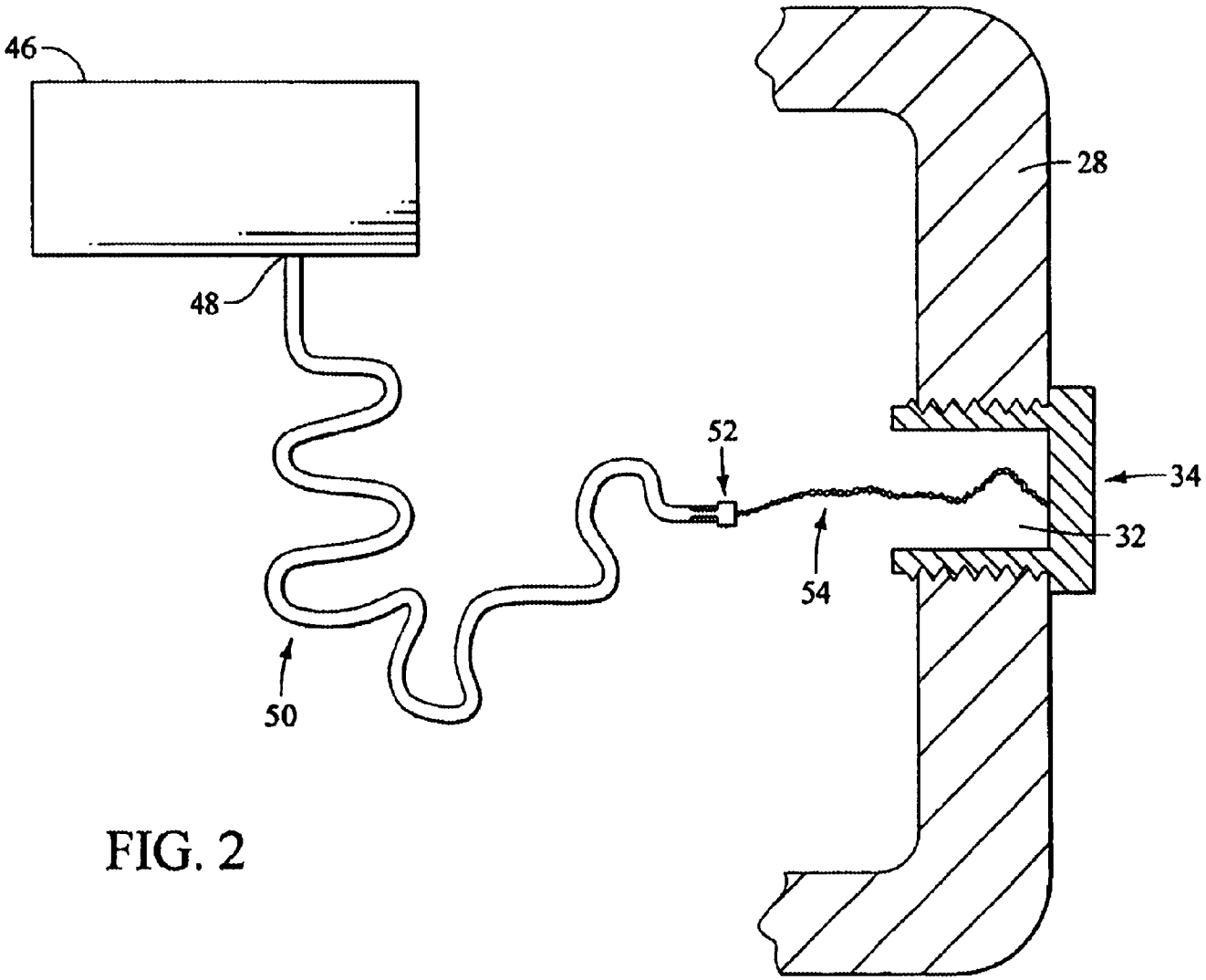
FIG. 2 is a schematic of an oil drain system in a non-operational mode according to a preferred embodiment of the present invention.

FIG. 2 depicts a preferred embodiment of the oil drain system. The oil drain system includes an oil reservoir 46 positioned within the hull 28. Oil reservoir 46 retains oil for lubricating the engine. The oil reservoir 46 includes a oil drain 48 that may be formed on the lower aft side of the reservoir 46 so that oil can exit the reservoir by means of gravity. A conduit 50 formed of rubber, plastic, or any other suitable material, is attached at its proximal end to the drain 48 by conventional means. A flow regulator 52, with an open and closed state is positioned at the distal end of the conduit 50. The flow regulator 52 may be a plug or manually operable valve such as a petcock or any other suitable device for modulating the flow of a liquid through a conduit. In the closed state, the flow regulator 52 retains the oil within the oil reservoir 46 and conduit 50. Located at the rear or aft of the watercraft is a water drain opening 32 that allows the hull 28 of the watercraft to be drained of water. The water drain opening 32 is sealed with a cover 34 or other suitable sealing device. A tether 54 is attached at its distal end to the interior of the water drain cover 34. The proximal end of the tether 54 is coupled to the conduit 50. The tether 54 may be formed of plastic, metal, or any other suitable material. Additionally, the tether 54 may be a linked chain, or, alternatively, a non-linked solid length of any suitable material.

Figure 3:
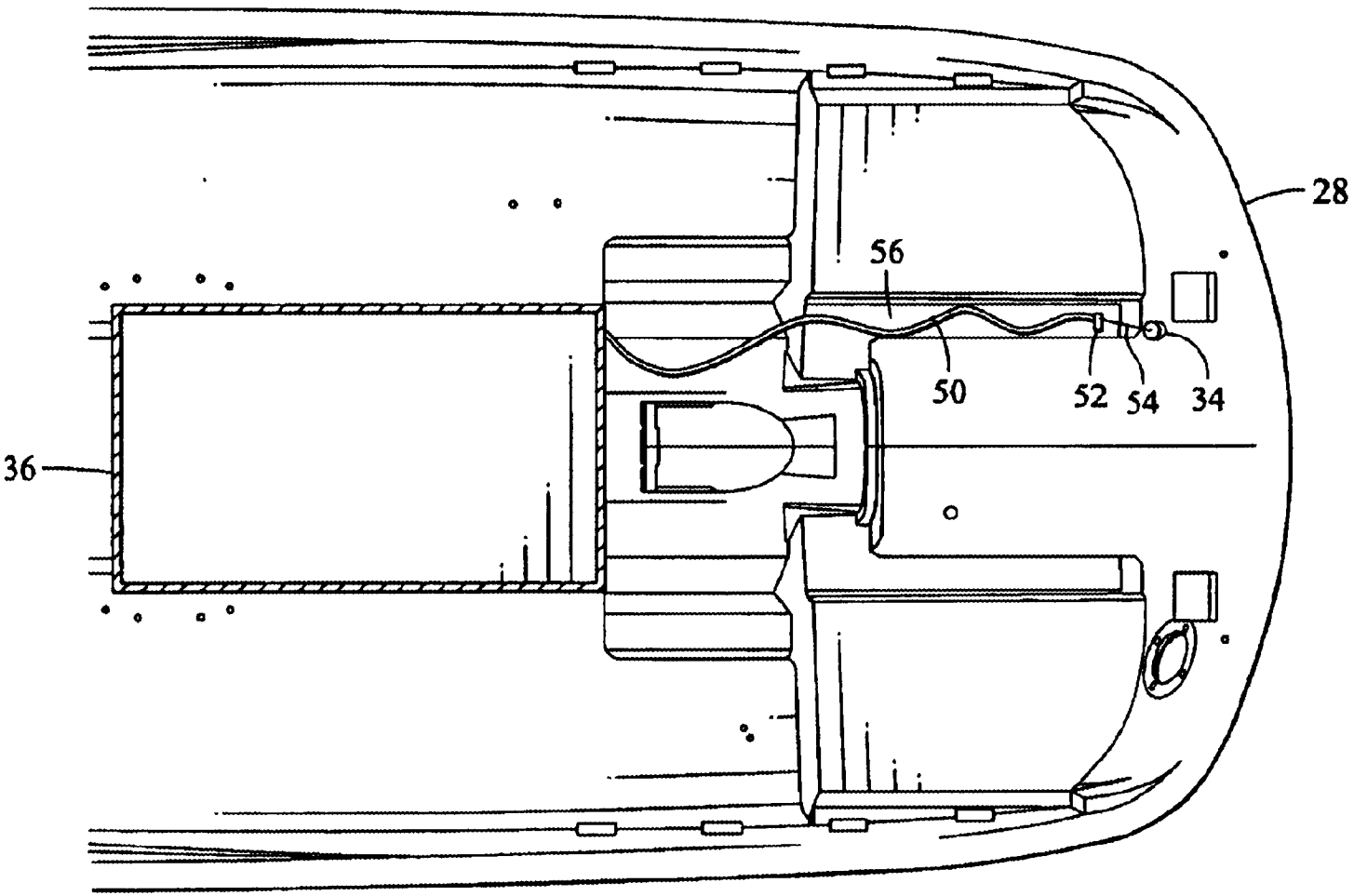
FIG. 3 is a view into the interior of a typical watercraft with the top deck removed including the oil drain system shown in FIG. 2.
Figure 4:
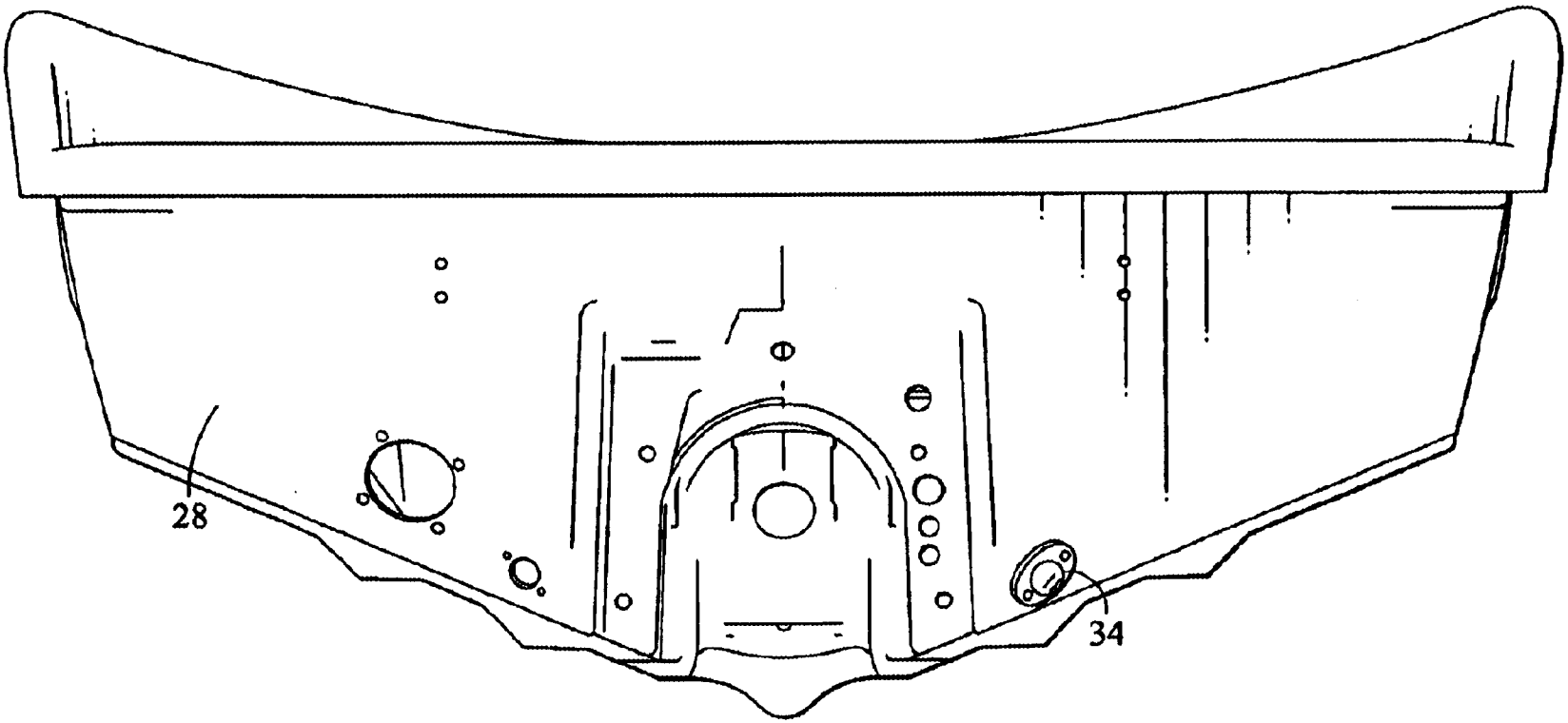
FIG. 4 is a rear view of a typical watercraft including a water draining access opening.

FIGS. 3 and 4 depict the oil drain system of the embodiment shown in FIG. 2 in place in a typical personal watercraft. Oil reservoir (not shown) sits below the engine 36. A conduit 50 coupled to the oil reservoir runs through the hull 28, which may include a channel 56 defining the lowest point to facilitate the evacuation of oil from the oil reservoir 46 and water from the hull 28. Conduit 50 includes a flow regulator 52 coupled at its distal end. Conduit 50 and flow regulator 52 are coupled to the proximal end of a tether 54. In the non-operative state, conduit 50, flow regulator (in the closed state) 52, and tether 54 are positioned within the interior of the hull 28. The distal end of the tether 54 is attached to a water drain opening cover 34 provided in the hull 28 such that when the water drain cover 34 is removed and pulled away from the watercraft the tether 54 engages the conduit 50 and flow regulator 52 and pulls the same to the exterior of the watercraft.

Figure 5:
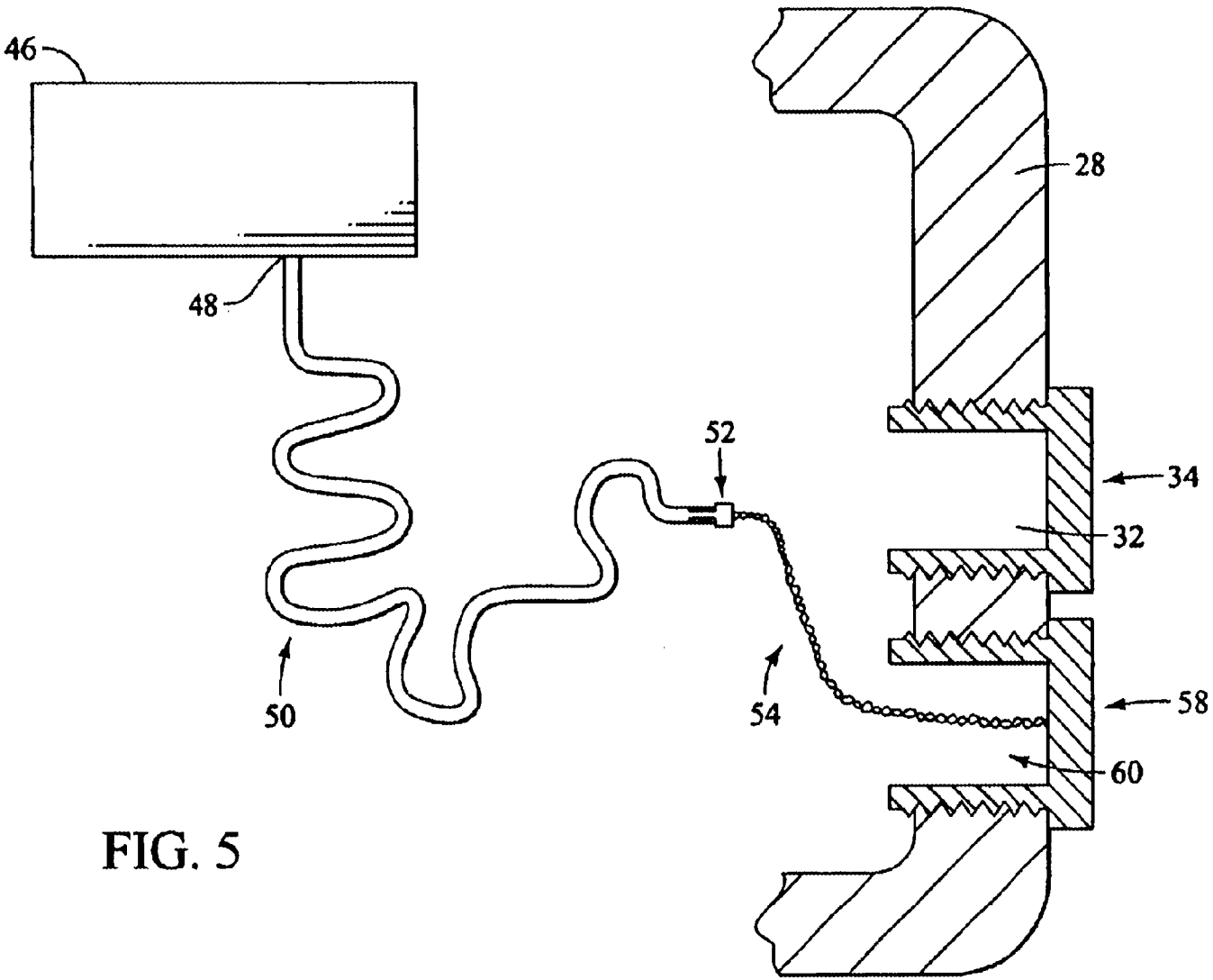
FIG. 5 is a schematic of an oil drain system in a non-operational mode according to another preferred embodiment of the present invention.

FIG. 5 depicts a second preferred embodiment of the oil drain system. In the embodiment shown here, the tether 54 is coupled to a cover 58 associated with an access opening 60 (separate from the water drain opening) formed in the hull 28.

Figure 6:
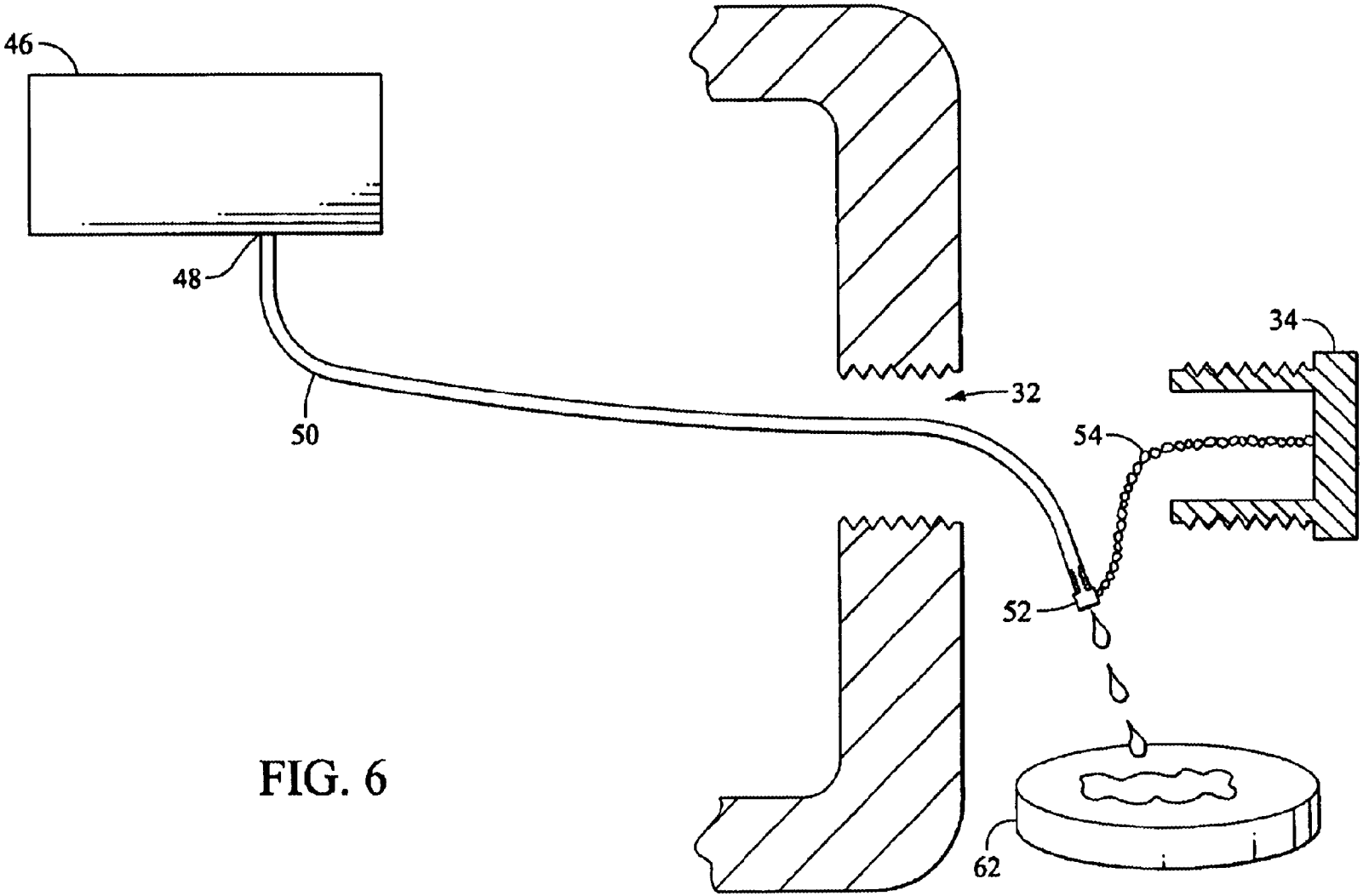
FIG. 6 is a schematic of the oil drain system shown in FIG. 2 in operational mode.

FIG. 6 depicts the oil drain system FIG. 2 in operation. During routine maintenance and oil change, the watercraft is removed from the water. In the case of the embodiment depicted in FIG. 2, the person servicing the watercraft removes the water drain cover 34 (and may remove any water collected in the hull). As the water drain cover 34 is pulled away from the watercraft the tether 54 engages and pulls the conduit 50 and flow regulator 52 through the water drain opening 32 and into the reach of the service person. In the case of the embodiment depicted in FIG. 5, the service person removes the alternative access opening cover 58 and pulls the cover away from the watercraft to engage the tether 54 to pull the conduit 50 and flow regulator 52 through the alternative access opening 60 to the exterior of the watercraft. The service person then opens the flow regulator 52 and places it at level below the oil drain 48, gravity pulls the oil contained in the oil reservoir 46 through the conduit 50 and open flow regulator 52. The oil may be emptied into a oil pan 62 or other suitable receptacle. When the oil draining process is complete, the conduit 50, flow regulator 52, and tether 54 are inserted back into the interior of the hull 28. In the case of the embodiment depicted in FIG. 2, the water drain opening cover 34 is inserted into the water drain opening 32. In the case of the embodiment depicted in FIG. 5, the access opening cover 58 is inserted into the access opening 60.

While preferred embodiments of the present invention have been described, it should be understood that various changes, adaptations, and modifications may be made without departing from the spirit of the invention and the scope of the appended claims.

What is claimed is:

1. An oil draining system comprising;

an oil reservoir having a flow regulator coupled thereto, the reservoir located in an interior of a vehicle;

an access opening located on an exterior of the vehicle;

a cover removably located over the access opening on the exterior of the vehicle; and a tether coupling the flow regulator of the oil reservoir to an interior of the cover, wherein when the cover is removed from the access opening, the flow regulator can be pulled through the access opening by the tether so that oil in the reservoir can be drained to the exterior of the vehicle.

2. The oil draining system of claim 1 wherein the flow regulator is coupled to the oil reservoir by a conduit.

3. The oil draining system of claim 2 wherein the conduit is a flexible hose.

4. The oil draining system of claim 1 wherein the flow regulator is a manually operable valve.

5. The oil draining system of claim 1 wherein the flow regulator is a manually operable plug.

6. The oil draining system of claim 1 wherein the tether is a linked chain.

7. The oil draining system of claim 1 wherein the tether is formed of plastic.

8. The oil draining system of claim 1 wherein the tether is formed of metal.

9. The oil draining system of claim 1 wherein the access opening is provided in the hull of a watercraft.

10. The oil draining system of claim 9 wherein the access opening is a water drain opening located in the exterior of the vehicle.

11. The oil drain system of claim 9 wherein the access opening is separate from a water drain opening.

12. A jet-propelled personal watercraft comprising;

a hull including a bottom hull and a top deck secured over the bottom hull, the hull defining an engine compartment sized to contain an internal combustion engine for powering a jet propulsion unit, the jet propulsion unit including a steerable water discharge nozzle, the top having a raised, longitudinally extending seat adapted to accommodate an operator in straddle fashion;

a lubricating system to lubricate the engine including;

an oil reservoir with a drain formed therein, the oil reservoir coupled to a flow regulator;

an access opening;

a cover having an interior and exterior removably located over the access opening; and a tether coupling the flow regulator of the oil reservoir to the interior of the access opening cover.

13. The watercraft of claim 12 wherein the access opening is provided on an exterior of a hull of the watercraft.

14. The watercraft of claim 13 wherein the access opening is the water drain opening.

15. The watercraft of claim 13 wherein the access opening is separate from a water drain opening.

16. The watercraft of claim 12 wherein the oil reservoir is coupled to the flow regulator by a conduit.

17. The watercraft of claim 16 wherein the conduit is formed of flexible hose.

18. The watercraft of claim 12 wherein the flow regulator is a manually operable valve.

19. The watercraft of claim 12 wherein the flow regulator is a manually operable plug.

20. The watercraft of claim 12 wherein the tether is linked chain.

21. The watercraft of claim 12 wherein the tether is formed of plastic.

22. The watercraft of claim 12 wherein the tether is formed of metal.

23. A method of draining oil from a vehicle, the method comprising the steps of;

(a) removing a cover from an access opening located on an exterior of the vehicle;

(b) pulling the cover away from the access opening, the cover having a tether coupling the cover to a flow regulator that has an open and closed position, the flow regulator being coupled to an oil reservoir located in an interior of the vehicle, wherein the tether pulls the flow regulator through the access opening so that it is accessible from the exterior of the vehicle;

(c) opening the flow regulator;

(d) draining the oil through the flow regulator;

(e) closing the flow regulator;

(f) returning the flow regulator to the interior of the vehicle; and (g) replacing the cover over the access opening.

24. An oil drain system comprising;

an oil reservoir with an oil drain formed therein;

draining means attached at its proximal end to the oil drain;

connecting means attached at its proximal end to the distal end of the draining means; and access opening cover means attached to the distal end of the connecting means.

25. The oil drain system of claim 24 wherein the connecting means is a tether.

26. The oil drain system of claim 25 wherein the tether is formed of metal.

27. The oil drain system of claim 25 wherein the tether is formed of plastic.

* * * * *